US006725622B1

(12) United States Patent
Hsu

(10) Patent No.: US 6,725,622 B1
(45) Date of Patent: Apr. 27, 2004

(54) METHOD OF PRODUCING ARC WINDOW FRAMES

(75) Inventor: Pey-Son Hsu, Changhua Hsien (TW)

(73) Assignee: Ching Feng Blinds, Ind. Co., Ltd., Changhua Hsien (TW)

( * ) Notice: Subject to any disclaimer, the term of this patent is extended or adjusted under 35 U.S.C. 154(b) by 0 days.

(21) Appl. No.: 10/384,548

(22) Filed: Mar. 11, 2003

(51) Int. Cl.[7] ..... E04B 1/00
(52) U.S. Cl. ..... 52/745.07; 52/211; 52/745.08
(58) Field of Search ..... 52/745.07, 745.05, 52/745.08, 82, 86, 88, 211; 49/82.1; 264/31, 32, 33

(56) References Cited

U.S. PATENT DOCUMENTS 4,563,846 A * 1/1986 Webb ..... 52/208
4,669,233 A * 6/1987 Minter ..... 52/86
4,780,998 A * 11/1988 Knapp ..... 52/211
4,825,611 A * 5/1989 Bassett ..... 52/222
4,955,168 A * 9/1990 Barry ..... 52/210
5,115,605 A * 5/1992 Butler ..... 52/105
5,471,789 A * 12/1995 Faircloth ..... 49/74.1
5,537,780 A * 7/1996 Cleaver et al. ..... 49/82.1
6,257,301 B1 * 7/2001 Conforti ..... 160/84.07
6,401,405 B1 * 6/2002 Hicks ..... 52/88

* cited by examiner

*Primary Examiner*—Leslie A. Braun
*Assistant Examiner*—Tan Le
(74) *Attorney, Agent, or Firm*—Troxell Law Office PLLC

(57) ABSTRACT

A method of producing an arc window frame has an arc window frame mainly made up of an arc decorative board, an arc upper frame, an arc lower frame, and a lower board. The arc decorative board is mounted onto the outer circumference of the arc upper frame, and the lower board screw joined to the bottom of both arc upper frame and lower frame thereof. The arc upper frame has a plurality of equally spaced sleeve holes disposed at the inner circumference thereof and the arc lower frame has a plurality of through holes equidistantly disposed at the outer circumference thereof, to which blades can be sleeve joined in radial shape and be easily adjusted into different angles for use. A small lower board is fastened on top of the lower board at the space defined by the arc lower frame, and two semicircular plates are fixed to the front and rear sides of the arc lower frame to complete the production thereof; whereby, the arc window frame is mainly molded via the material of foam plastics which is convenient, fast and easy in the process of production as well as beautiful in display as a whole.

2 Claims, 7 Drawing Sheets

METHOD OF PRODUCING ARC WINDOW FRAMES

BACKGROUND OF THE INVENTION

The present invention is related to a method of producing an arc window frame wherein said arc window frame is mainly made up of an arc decorative board, an arc upper frame, an arc lower frame, a lower board, blades, a small lower board, and a pair of semicircular plates. Said arc decorative board is fastened to the top of said arc upper frame, and said lower board is screw joined to the bottom of both said arc upper frame and lower frame thereof. Said blades, joined to both arc upper frame and lower frame in radial shape via inserted pins disposed at both ends thereof, can also be adjusted in different angles for use. Said small lower board is located on top of said lower board, while said semicircular plates are adapted to cover both sides of said arc lower frame to complete the production thereof; whereby, said arc window frame, mainly molded via the material of foam plastics, is convenient, fast, and easy in production as well as beautiful in display as a whole.

Please refer to FIG. 1. A conventional arc window frame 10 is mainly made up of an arc wooden frame 11 having an inserted groove 111 defining the inner circumference thereof, and a lower board 12 securely fixed to the bottom of said arc wooden frame 11 thereof. Said lower board 12 has an engaging groove 121 disposed at the upper facet thereof. A semicircular colored glass 12 is joined to said inserted groove 111 and said engaging groove 121 thereof and located at the space defined by said arc wooden frame 11 and said lower board 12 therein. A pair of decorative bars 14 is adapted to the front side of said semicircular colorful glass 12 in V shape.

There are some drawbacks to such conventional arc window frame 10. Most of all, said arc wooden frame 11 is made by carving, which makes the process of production both inconveniently complex and uneconomically time-consuming.

SUMMARY OF THE PRESENT INVENTION

It is, therefore, the primary purpose of the present invention to provide a method of producing an arc window frame wherein said arc window frame is mainly molded via the material of foam plastics, which is more convenient, faster, and easier in the process of production as well as more beautiful in display as a whole.

It is, therefore, the secondary purpose of the present invention to provide a method of producing an arc window frame wherein said arc window frame is equipped with a plurality of blades which, each joined to an arc upper frame and an arc lower frame in radial shape for beautiful display, can also be adjusted into different angles for practical use.

DETAILED DESCRIPTION OF THE PREFERRED EMBODIMENTS

Figure 1:
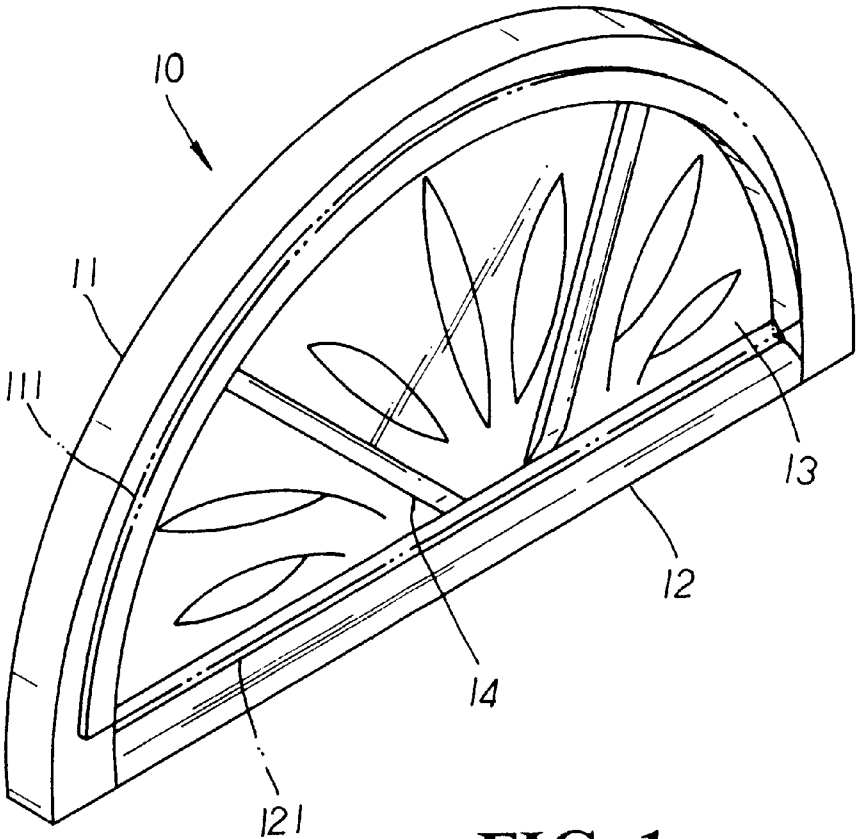
FIG. 1 PRIOR ART
FIG. 1 is a perspective view of a conventional arc window frame.
Figure 2:
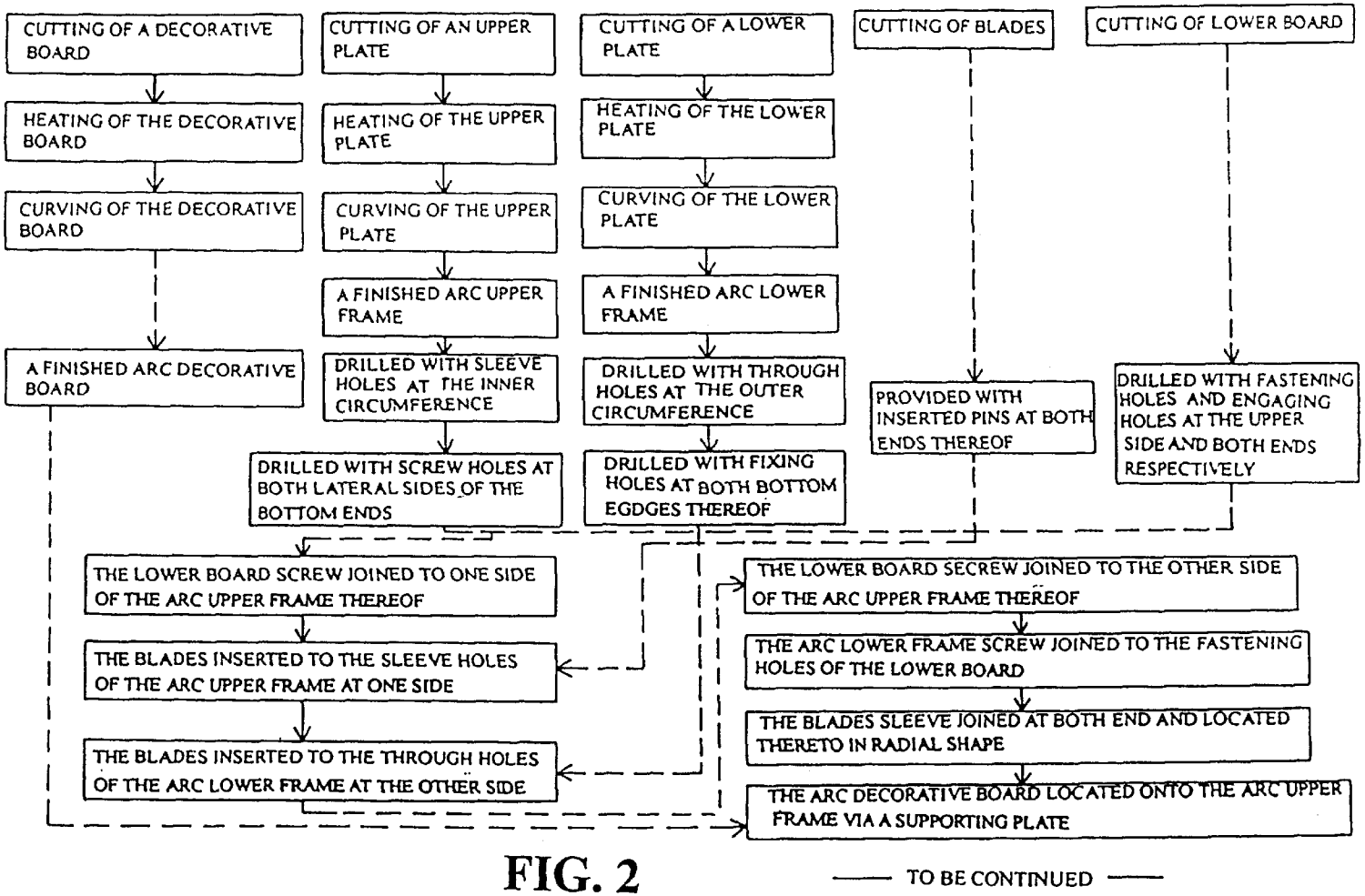
FIG. 2 is a flow chart of the present invention.
Figure 2:
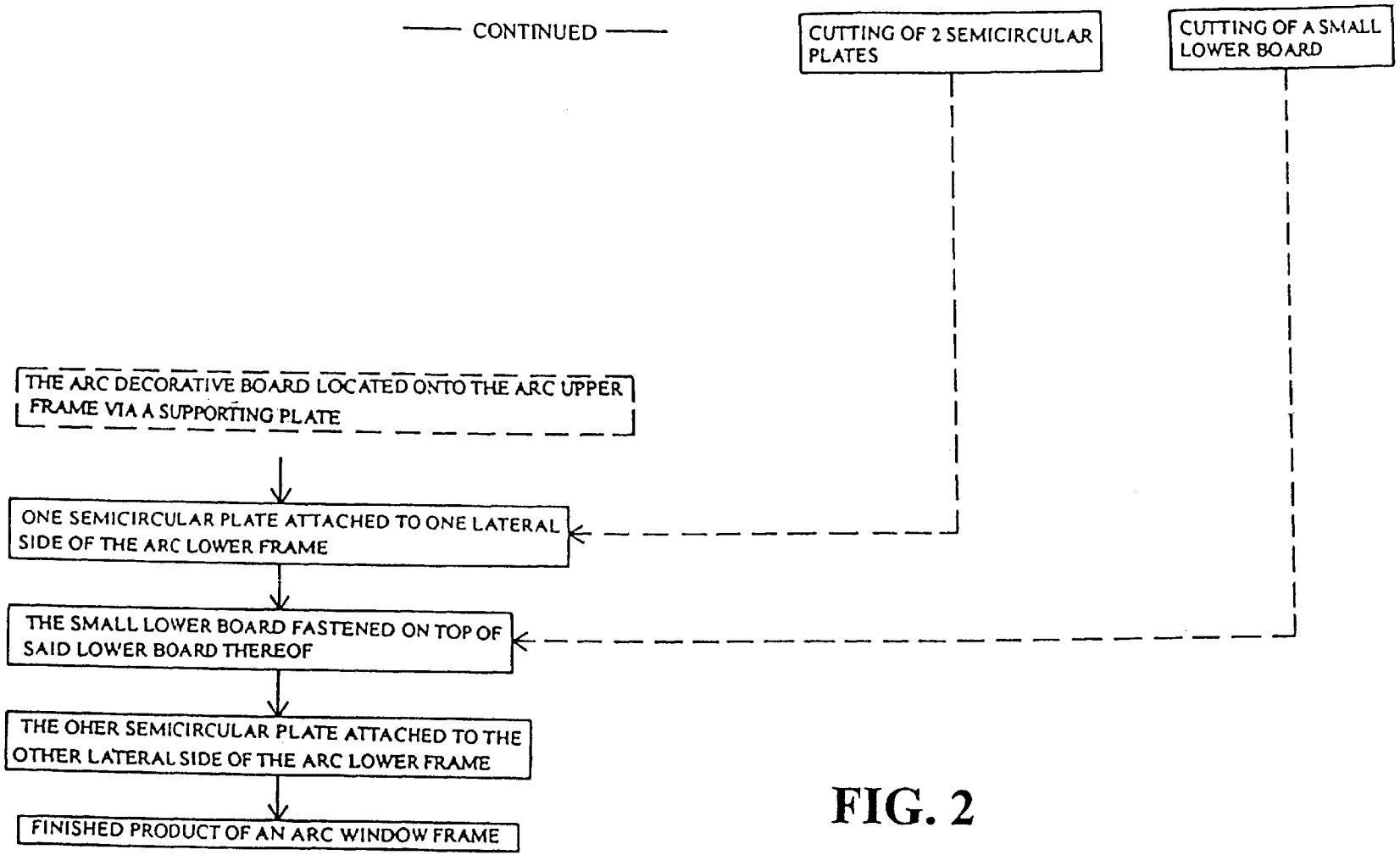
Figure 3:
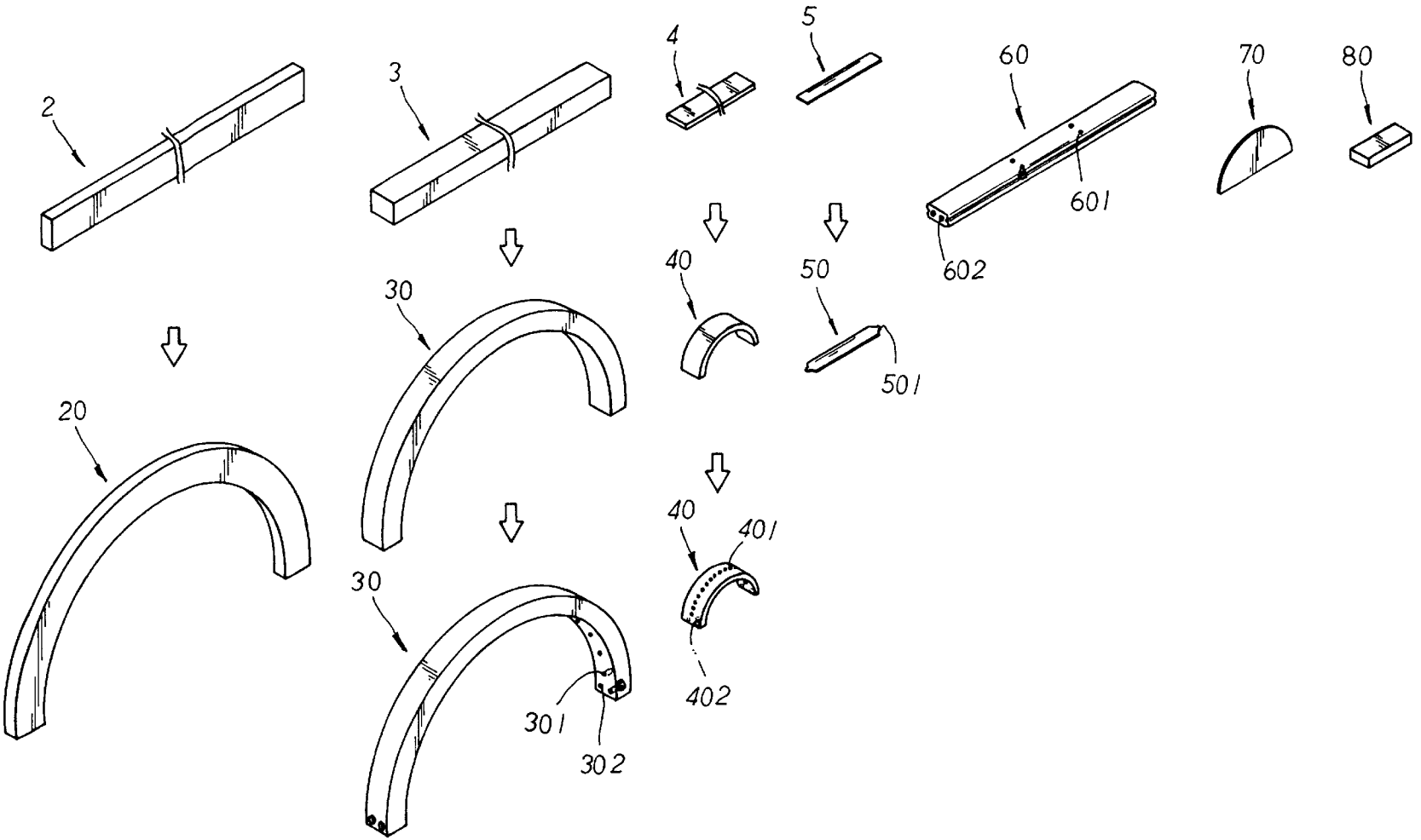
FIG. 3 is a diagram showing the process of production of the present invention.
Figure 4:
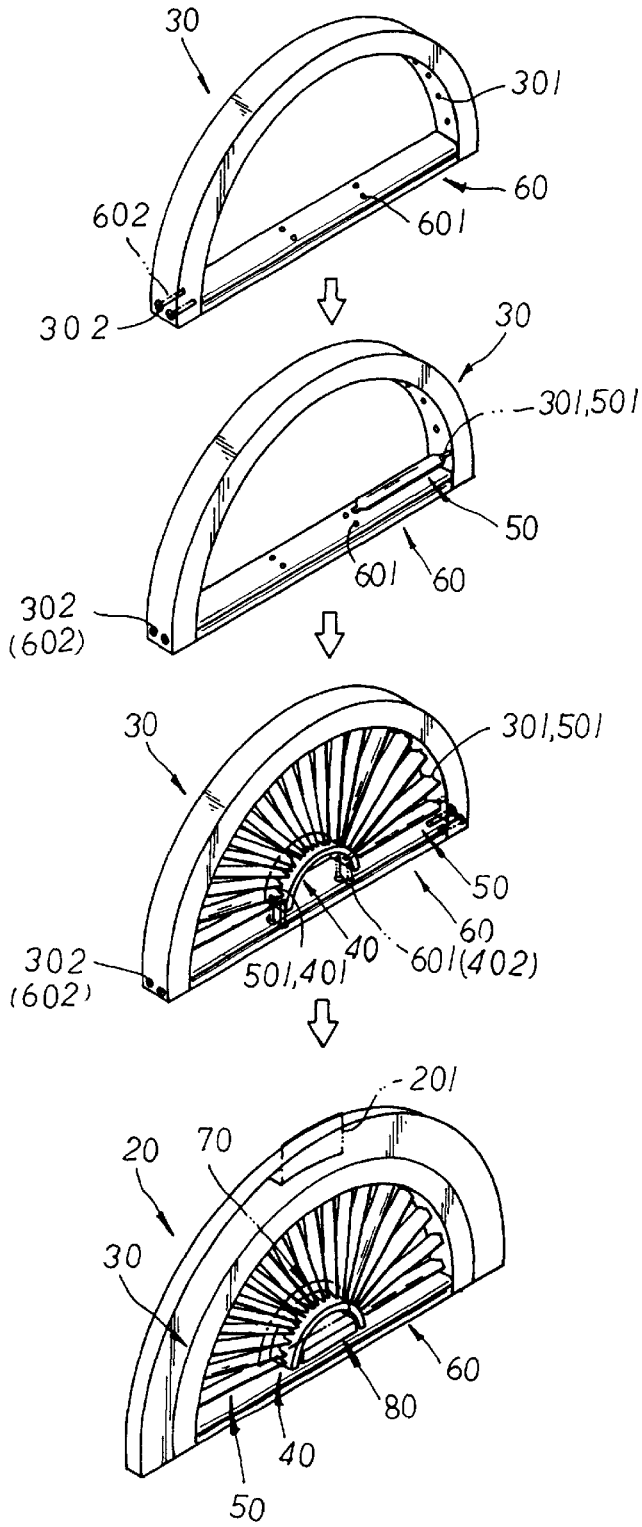
FIG. 4 is another diagram showing the process of production thereof.

Please refer to FIG. 2 along with FIGS. 3, 4. The present invention is related to a method of producing an arc window frame, comprising steps as follows:

First, a decorative board 2, an upper plate 3, and a lower plate 4 are molded by foam plastics and cut into a proper length and width respectively. Said decorative board 2, upper plate 3, and lower plate 4 are then heated and softened before placed onto a curving machine and bent into an arc decorative board 20, an arc upper frame 30, and an arc lower frame 40 respectively. The inner circumference of said arc decorative board 20 has the same radian as the outer circumference of said arc upper frame 30 thereof.

Second, said arc upper frame 30 and lower frame 40 are further processed on a platform. Said arc upper frame 30 is driven by an air drill to provide with a plurality of equally spaced sleeve holes 301 distributed properly at the inner circumference thereon, and a pair of screw holes 302 disposed at each lateral side of the bottom ends thereof. And said arc lower frame 40 is also driven via an air drill with a plurality of through holes 401 equidistantly distributed at the outer circumference thereon and a pair of fixing holes 402 disposed at each bottom edge thereof.

Third, a plurality of bars 5 is molded via foam plastics and cut into pieces of proper length and width. Said bars 5 are then punched into a plurality of blades 50 each having an inserted pin 501 extending outwards at both ends thereof respectively. A lower board 60, two semicircular plates 70 and a small lower board 80 are also molded via foam plastics and cut into pieces of proper length and width respectively. Said lower board 60 is equipped with a plurality of fastening holes 601 distributed properly at the upper facet thereon, a pair of engaging holes 602 disposed at each lateral edge thereof respectively, and a length matching to the space defined by both bottom ends of said are upper frame 30 thereof.

Fourth, said lower board 60 is adapted and fixed to one bottom end of said arc upper frame 30 via one pair of said engaging holes 602 thereof correspondingly screw joined to one pair of the screw holes 302 thereof. Said blades 50 are sleeve joined to said arc upper frame 30 and said arc lower frame 40 at both ends thereof in radial shape via said inserted pins 501 thereof engaging with the sleeve holes 301 thereof at one side and with the through holes 401 thereof at the other side. Said lower board 60 is then securely attached to the other bottom end of said arc upper frame 30 via the other pair of said engaging holes 602 fixedly joined to the other pair of screw holes 302 thereof. The arc lower frame 40 is then screw joined to the lower board 60 via said fixing holes 402 thereof and said fastening holes 601 thereof.

Figure 5:
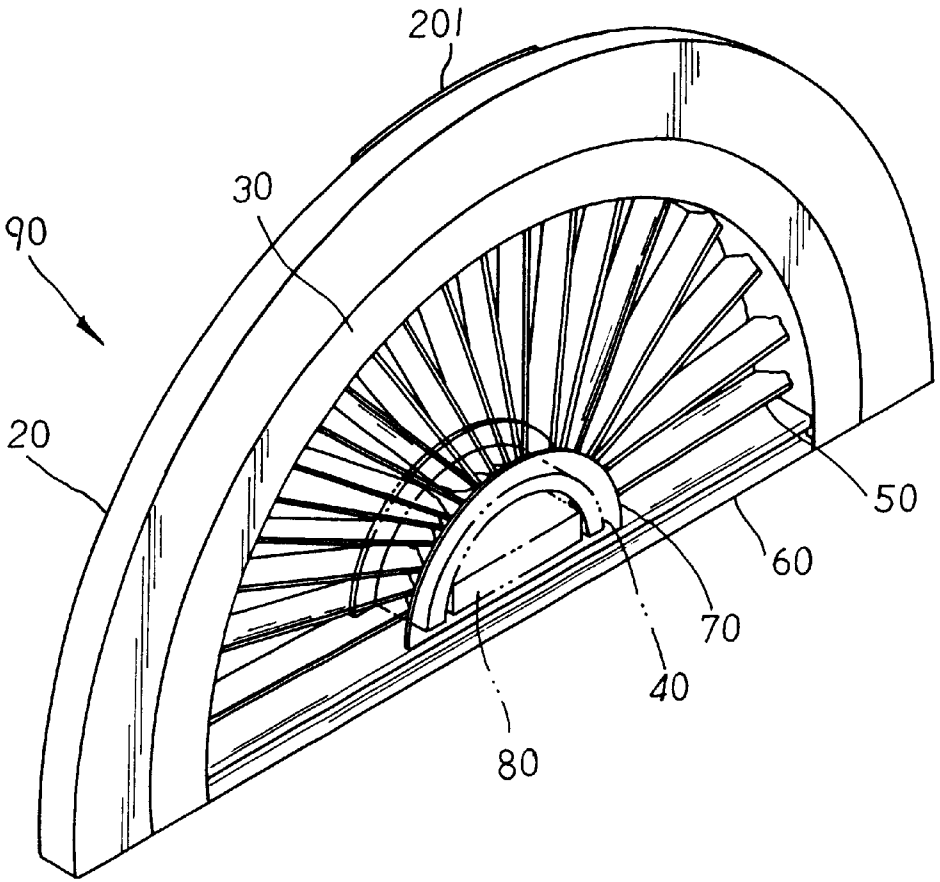
FIG. 5 is a perspective view of the present invention.

Fifth, said arc decorative board 20 is mounted and fastened onto the outer circumference of said arc upper frame 30 thereof. A supporting plate 201 is applied thereon for location thereof. Said small lower board 80 is adapted to the inner side of said arc lower frame 40 and fixedly fastened thereto on top of said lower board 60 thereof. Said two semicircular plates 70 are then applied and fixedly fastened to both front and rear sides of said arc lower frame 40 to complete the production of a delicate and good-looking arc window frame 90 as shown in FIG. 5.

Figure 6:
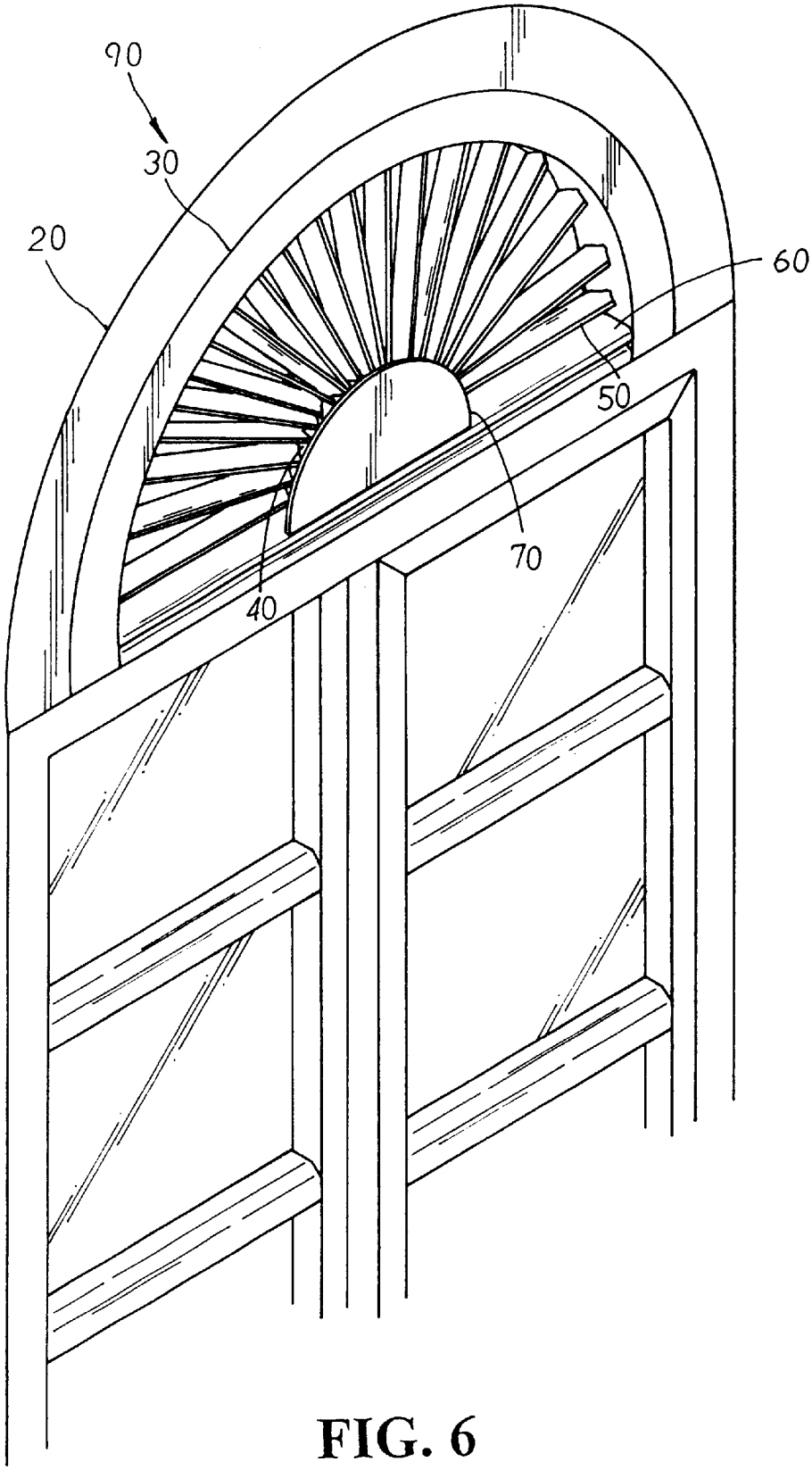
FIG. 6 is a perspective view of the present invention in practical use.

Please refer to FIG. 6. In practical use, said arc window frame 90 is properly located and mounted onto a window or a door. Said blades 50 can be properly adjusted in angle for use. Said arc window frame 90, mainly molded by the material of foam plastics, is more convenient, faster, and easier in the process of production as well as more beautiful in display as a whole.

What is claimed is:

1. A method of producing an arc window frame, comprising steps as follows:

first, a decorative board, an upper plate, and a lower plate, molded by foam plastics and each cut into a proper length and width, are heated and softened before bent via a curving machine into an arc decorative board, an arc upper frame, and an arc lower frame respectively wherein the inner circumference of said arc decorative board having the same radian as the outer circumference of said arc upper frame thereof;

second, said arc upper frame and lower frame being further processed on a platform wherein said arc upper frame driven by an air drill to provide with a plurality of equally spaced sleeve holes distributed properly at the inner circumference thereon and a pair of screw holes disposed at each lateral side of the bottom ends thereof, and said arc lower frame being drilled with a plurality of through holes equidistantly distributed at the outer circumference thereon and a pair of fixing holes disposed at each bottom edge thereof;

third, a plurality of bars, molded via foam plastics and cut into pieces of proper length and width, being punched into a plurality of blades each having an inserted pin disposed at both ends thereof respectively; a lower board, two semicircular plates and a small lower board being also molded via foam plastics and cut into pieces of proper length and width respectively wherein said lower board being equipped with a plurality of fastening holes distributed properly at the upper facet thereon, a pair of engaging holes disposed at each lateral edge thereof respectively, and a length properly matching to the space defined by both bottom ends of said arc upper frame thereof;

fourth, in assembly, said lower board is adapted and fixed to one end of said arc upper frame via one pair of said engaging holes thereof correspondingly screw joined to one pair of the screw holes thereof; said blades are sleeve joined to said arc upper frame and said arc lower frame at both ends thereof in radial shape via said inserted pins thereof engaging with the sleeve holes thereof at one side and with the through holes thereof at the other side; said lower board is then securely attached to the other bottom end of said arc upper frame via the other pair of said engaging holes fixedly joined to the other pair of screw holes thereof; the arc lower frame is then screw joined to the lower board via said fixing holes and said fastening holes thereof;

fifth, said arc decorative board is mounted and fastened onto the outer circumference of said arc upper frame thereof with a supporting plate applied thereon for location thereof; said small lower board is adapted to the inner side of said arc lower frame and fixedly fastened on top of said lower board thereof; said two semicircular plates are fixedly attached to both front and rear sides of said arc lower frame to complete the production of a delicate and good-looking arc window frame which can be properly located and mounted onto a window or a door with said blades adjustable in different angles for use.

2. The method of producing an arc window frame as claimed in claim 1 wherein the arc decorative board, arc upper frame, arc lower frame, lower board, blades, small lower board, and semicircular plates of said arc window frame are mainly molded by the material of foam plastics.

* * * * *